United States Patent [19]

Shankman

[11] Patent Number: 4,970,735

[45] Date of Patent: Nov. 20, 1990

[54] SEATING DEVICE

[76] Inventor: Martin Shankman, 141 W. 24th St., Hialeah, Fla. 33011

[21] Appl. No.: 508,684

[22] Filed: Apr. 13, 1990

[51] Int. Cl.[5] ..... A47C 17/13; A47C 17/32

[52] U.S. Cl. ..... 5/20; 5/55.1

[58] Field of Search ..... 5/20, 8, 12 R, 17, 18, 5/55 R, 55 B, 2 B

[56] References Cited

U.S. PATENT DOCUMENTS 3,547,487 12/1970 Shankman ..... 5/20

3,825,959 7/1974 Shankman ..... 5/20

*Primary Examiner*—Alexander Grosz

*Attorney, Agent, or Firm*—Oltman and Flynn

[57] ABSTRACT

The present seat has a fixed, lower, first frame and a pair of second frames on top on opposite sides of the centerline of the first frame and each angularly adjustable between a retracted (sofa) position and an extended (bed) position at a right angle to the retracted position. Each second frame has a downwardly-projecting lock member for releasable engagement with an outer rail of the first frame on that side of its centerline when the second frame is in its retracted position. Rings of rubber-like material are sandwiched vertically between each second frame and the first frame to enhance the locking action when a person sits on that side of the seating device. A pair of back rests are removably mounted in sockets on the back ends of the outer rails of the first frame. Each back rest has a pillow-supporting frame that is angularly adjustable against the back of a person leading against that back rest. Arm rests are removably attachable to the second frames along their laterally outward extremities in the retracted position.

13 Claims, 4 Drawing Sheets

SEATING DEVICE

BACKGROUND OF THE INVENTION

My U.S. Pat. No. 3,825,959 discloses a seating device that is convertible from a two-seat sofa to side-by-side single beds, or vice versa.

SUMMARY OF THE INVENTION

This invention relates to novel and advantageous modifications and improvements in the convertible seating device of my aforementioned patent.

One principal object of this invention is to provide e novel and simplified arrangement for locking together the frames of the seating device when those frames are positioned to enable the seating device to be used as a sofa.

Another object of this invention is to provide such a locking arrangement whose security against accidental release is enhanced by the weight of a person or persons sitting on the sofa.

Another principal object of this invention is to provide a novel removable and angularly adjustable back rest for a seating device that is convertible between sofa and seat modes.

Another principal object of this invention is to provide a novel removable arm rest arrangement on a seating device that is readily adjustable between use as a sofa and use as a bed.

Further objects and advantages of this invention will apparent from the following detailed description of a presently preferred embodiment which is illustrated schematically in the accompanying drawings.

Figure 1:
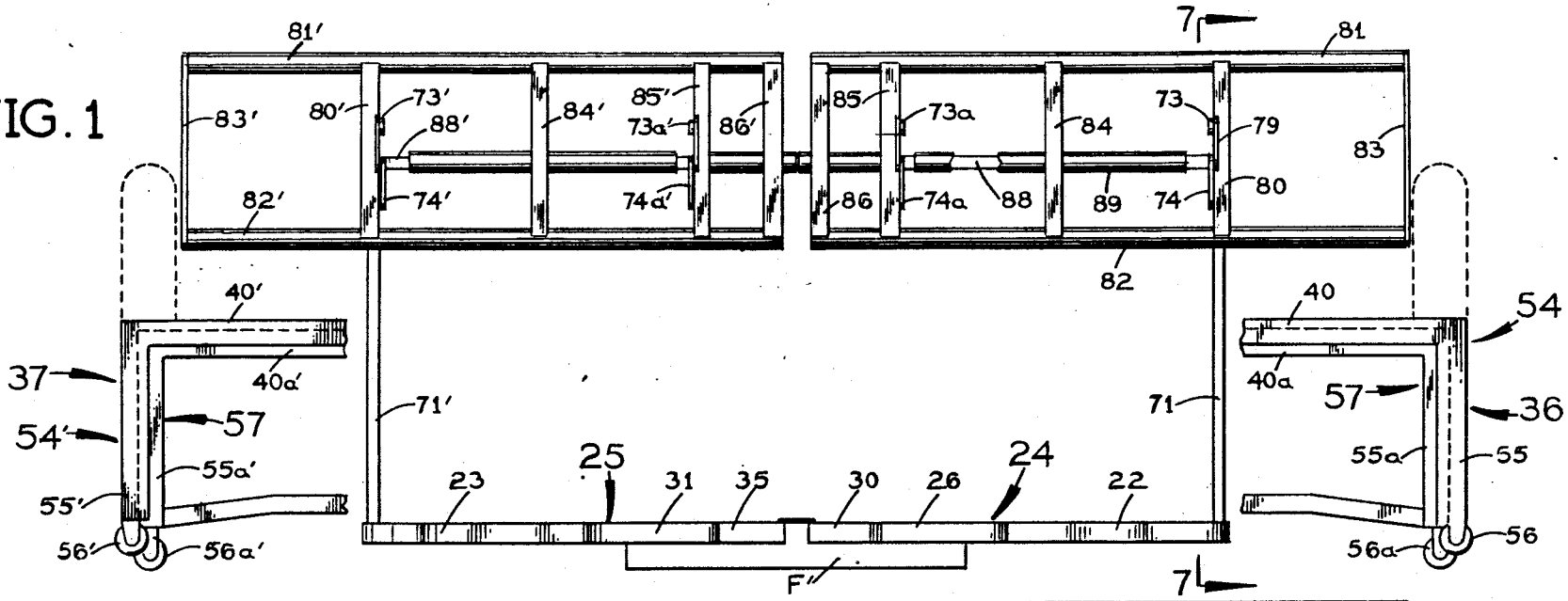
FIG. 1 is a front elevation of the framework of the present seating device, with parts broken away.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

In most respects the seating device of the present invention is identical to the one shown in my U.S Pat. No. 3,825,959. In the particular embodiment shown in the drawings, the seating device is a two-seat couch that is convertible into side-by-side beds, as in my U.S. Pat. No. 3,825,959. However, it is to be understood that the present seating device may be a single-seat chair that is convertible into a single bed.

The seating device has an underlying, fixed, first frame 15 (FIG. 3) on which the two seats are angularly adjustable horizontally between a retracted position in which the seating device is used as a couch and an extended position in which the seating device is used as a bed.

Figure 3:
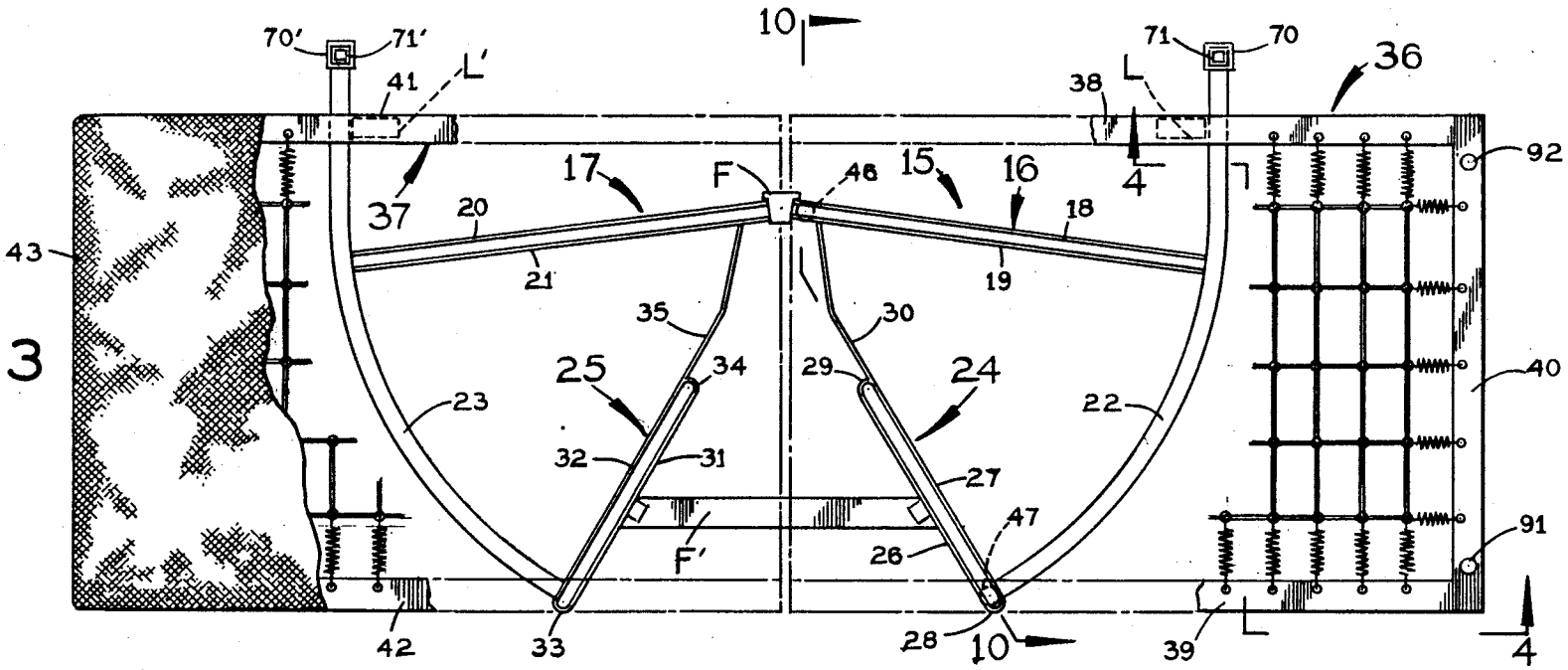
FIG. 3 is a top plan view of the bottom fixed frame in this framework and showing part of the horizontally adjustable frames immediately, above the fixed frame on each side.

The fixed first frame has two oppositely extending longitudinal trackways 16 and 17. Trackway 16 on the right side in FIG. 3 presents two straight, closely spaced, parallel rails 18 and 19, and trackway 17 on the left presents two straight, closely spaced, parallel rails 20 end 21. The inner ends of trackways 16 and 17 are rigidly attached to a foot F between them.

Figure 4:
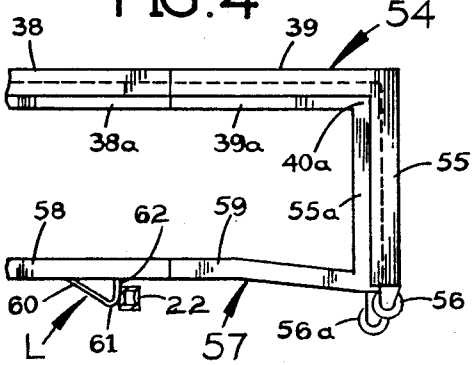
FIG. 4 is a vertical section taken along the line 4—4 in FIG. 3 and showing the positions of the parts when the seating device is used as a couch and a person is sitting on it.
Figure 5:
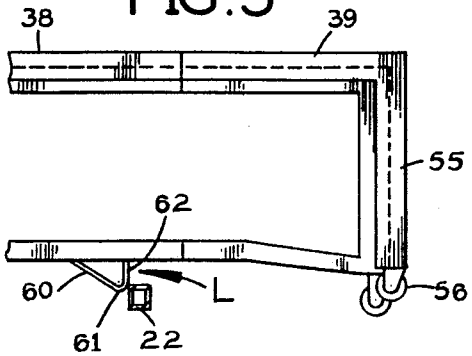
FIG. 5 is a view like FIG. 4 but showing the positions of the parts with no one sitting on the couch.
Figure 6:
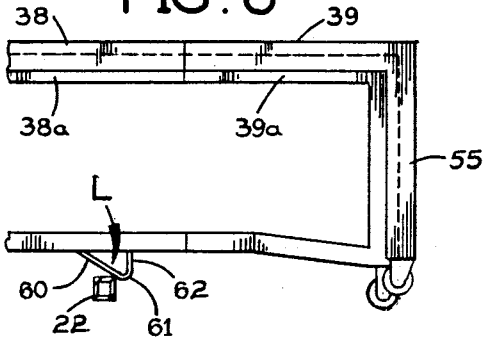
FIG. 6 is a view like FIGS. 4 and 5 but with the horizontally adjustable frame unlocked from the bottom, fixed frame below.

Frame 15 also has a curved outer rail 22 joined to the outer end of its longitudinal trackway 16 and a curved outer rail 23 joined to the outer end of its longitudinal trackway 17. Each outer rail has a hollow square cross section, as shown in FIGS. 4–6 for rail 22. The outer rails extend almost perpendicular to the respective longitudinal trackways 16 and 17 where they are joined. In front of the longitudinal trackways the outer rails 22 and 23 curve toward each other, and behind the longitudinal trackways the outer rails extend substantially parallel to each other.

Frame 26 also has two inner trackways 24 and 25 which extend generally at opposite acute angles to the respective longitudinal trackways 16 and 17. Trackway 24 comprises two straight rails 26 and 27 extending parallel to and closely spaced from each other and joined at their opposite ends by short arcuate segments 28 and 29. A bent extension 30 extends from the inner end segment 29 of trackway 24 to the foot F, to which it is rigidly attached. Trackway 25 has two similar straight rails 31 and 32, curved opposite end segments 33 and 34, and a bent segment 35 which connects the inner end segment 34 to the foot F. Near their outer ends the trackways 24 and 25 are rigidly attached to the front ends of the respective curved outer rails 22 and 23.

A floor-engaging, long, second foot member F′ (FIGS. 1–3) is attached rigidly to the trackways 24 and 25 of the first frame member near their front ends.

The seating device has two adjustable second frames 36 and 37 (FIGS. 1 and 2), one for each seat of the couch. Each second frame is individually adjustable angularly on the fixed first frame 15 between a retracted position in which the corresponding seat is positioned for use as a couch seat and an extended position in which the corresponding seat may be used as a bed. Second frame 36 extends above the first frame 15 on the right in FIG. 3, and second frame 37 extends above the first frame on the left side in that Figure. Each second frame 36 and 37 has slidably interfitting sections which closely fit together telescopically when that frame is in the retracted (couch) position end can be slideably extended to almost double its length when that frame is in its extended (bed) position.

As shown in FIG. 3, in its collapsed and retracted position the second frame 36 on the right side is generally rectangular (looking down) with an elongated, horizontal, straight, top back rail 38, an elongated, horizontal, straight, top front rail 39 extending parallel to back rail 38, and a horizontal, straight, outer top rail 40 joined to the back and front top rails 38 and 39 and extending perpendicularly between them. The second frame 37 on the left side is a mirror image of frame 36, presenting a back top rail 41, a front top rail 42, and an outer top rail 43.

As shown in FIGS. 4,5 and 6, the second frame 36 has a slidably extensible and retractable upper member 54 having the top rails 38, 39 and 40 appearing in FIG. 3 and vertical legs 55 which extend down at the front and back corners. Each leg 55 carries a caster 56 on its lower end.

Figure 10:
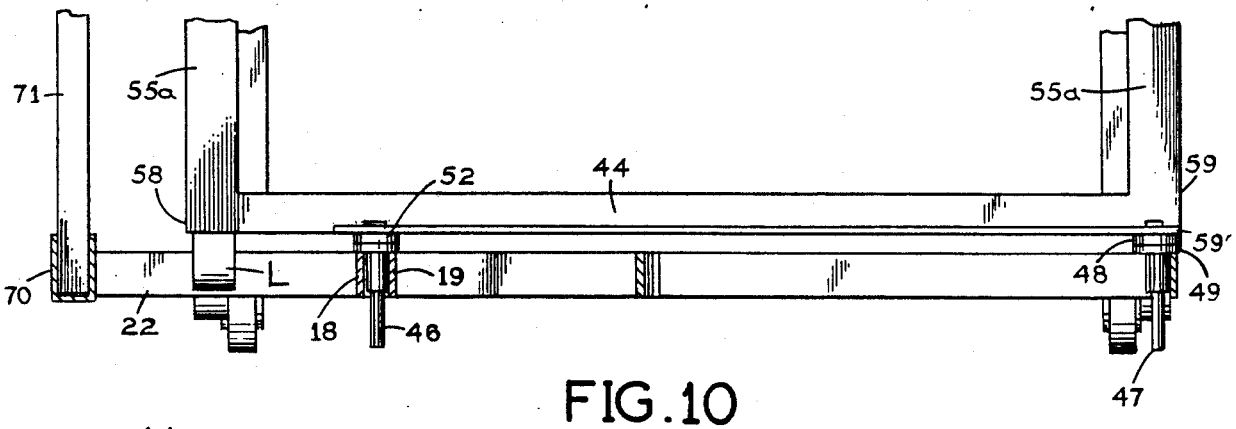
FIG. 10 is a vertical section taken along the line 10—10 in FIG. 2.
Figure 11:
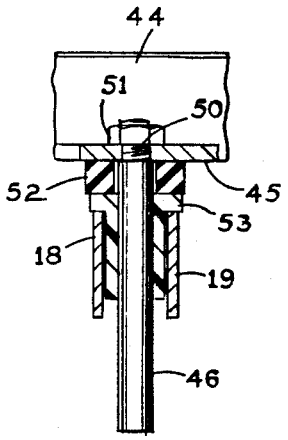
FIG. 11 is an enlarged vertical cross-section at one of the guide pins on one of the horizontally adjustable frames in this seating device.

The second frame 36 also has a lower member 57 with top rails 38*a*, 39*a* and 40*a* directly below and slidably supporting the correspondingly numbered rails of upper member 54, vertical outer legs 55*a* extending down from the top rails and carrying floor-engaging casters 56*a* on their lower ends, and rear and front lower rails 58 and 59 which are spaced vertically below the rear and front top rails 38*a* and 39*a* and are joined to the lower ends of legs 55*a*. As shown in FIG. 10, the lower member 57 of the second frame has an inner bottom rail 44 which extends horizontally between the inner ends of the rear and front lower rails 58 and 59. Rail 44 is a channel with a flat, horizontal, bottom wall 45 (FIG. 11).

A first guide pin 46 extends down from this bottom wall a short distance in front of the rear lower rail 58 of frame member 57. This guide pin is slidable along the longitudinal trackway 16, as shown in phantom in FIG. 3 and in section in FIGS. 10 and 11. In the retracted (couch) position of second frame 36, the guide pin 46 is at the inner end of trackway 16, as shown in FIG. 10. In the extended (bed) position of second frame 16, the guide pin 46 is at the outer end of this trackway.

The front lower rail 59 of frame member 57 has a channel-shaped cross-section with a flat bottom wall 59′ (FIG. 10). A second guide pin 47 extends down from bottom wall 59′ a substantial distance laterally outward from the inner bottom rail 44 of frame member 57. This guide pin is snugly but slidably received between the rails 26 and 27 of trackway 24. Pin 47 is at the front end of trackway 24 when second frame 36 is in its retracted (couch) position. FIG 47 is at the back end of trackway 24 when second frame 36 is in its extended (bed) position.

When second frame 36 is being turned from its retracted (couch) position to its extended (bed) position or vice versa, the extensible member 54 is in its collapsed position next to the lower member 57 of this frame. When the second frame 36 is in its extended position, the extensible member 54 may be slid out from the lower member 57 to make this frame long enough for a bed. The couch cushion then may be unfolded to serve as a bed mattress, as described in my U.S. Pat. No. 3,825,959.

As shown in FIG. 11, pin 46 has a screw-threaded stem 50 at its upper and which passes through an opening in the bottom wall 45 of inner bottom rail 44. A nut 51 threadedly engages this stem above wall 45 to clamp the pin 46 rigidly to the inner bottom rail 44. A compressible, resilient, annular member or ring 52 of rubber-like material encircles pin 46 directly below the bottom wall 45 of rail 44. A flanged bushing 53 of suitable anti-friction material receives the pin 46 directly below ring 52. This bushing is received snugly but slidably between the rails 18 and 19 of longitudinal trackway 16. The flange on the upper end of bushing 53 is engaged between the bottom of ring 52 and the top edges of trackway rails 18 and 19.

The assembly at the other guide pin 47 on the bottom of second frame 36 is identical, with an annular member or ring 48 of rubber-like material (FIG. 10) sandwiched between the front lower rail 59 and a flanged bushing 49 on pin 47.

The other second frame 37 of the seating device has an identical arrangement of two guide pins 46′ and 47′ projecting down from it and slidable along the trackways 17 and 25. The other second frame 37 has the same construction as frame 36 and is a mirror image of it. Elements of frame 37 which correspond to the elements of frame 36 have the same reference numerals, with a "prime" suffix added, in FIG. 2.

As disclosed in my U.S. Pat. No. 3,825,959, either couch seat may be turned on the fixed first frame 15 from the couch position to the bed position. When this is done on the right-hand seat, for example, the guide pin 46 on its second frame 36 slides laterally outward along trackway 18 and at the same time the other guide pin 47 slides back along trackway 24. The same type of action takes place when the left-hand seat is turned from the couch position to the bed position.

SEAT LOCKS

In accordance with one important feature of the present invention, the lower rear rail 58 of frame member 57 carries a downwardly projecting lock member L (FIG. 2) for releasable locking engagement with the outer rail 22 of the fixed first frame 15. This lock member (FIG. 4) has a downwardly and laterally outwardly inclined inner segment 60, a rounded bottom segment 61 joined to the inner segment 60 at its lower end, and a vertical outer segment 62 extending up from the rounded bottom segment 61 to rail 58.

As shown in FIG. 5, when the seat is in its retracted (couch) position, the rounded bottom segment 61 of the lock member is on the laterally inward side of the outer rail 22 of the fixed first frame 15 and it takes a deliberate pull on the seat to move the lock laterally out past rail 22.

In the retracted position of the seat, if a person sits on that seat his or her weight will move the lock down to a position as shown in FIG. 4, in which the seat is more securely locked in place on the fixed first frame 15. The compressible ring 52 at guide pin 46 and the corresponding ring 48 at guide pin 47 permit this short downward movement of the adjustable frame 36 with respect to the fixed frame 15.

With no one sitting on the seat, a deliberate pull on the seat will enable the rounded bottom segment 61 of the lock to ride over the top of rail 22 of the fixed first frame 15, so that continued movement of the frame takes place with no resistance by the lock as the seat is moved from the retracted (couch) position to the extended (bed) position.

When the seat is being moved from the bed position back to the couch position, in the final part of that movement the inclined segment 60 of the lock engages the top outer edge of rail 22 and slides up across it (FIG. 6) until the rounded bottom segment 61 engages the top of rail 22, after which segment 61 slides across the top of the rail and then drops into the locking position shown in FIG. 5.

The left-hand seat carries a lock L' (FIG. 3) which is a mirror image of lock L on the right-hand seat and coacts with the outer rail 23 of the fixed first frame in the same manner as just described in detail for lock L.

BACK REST FRAMES

Figure 7:
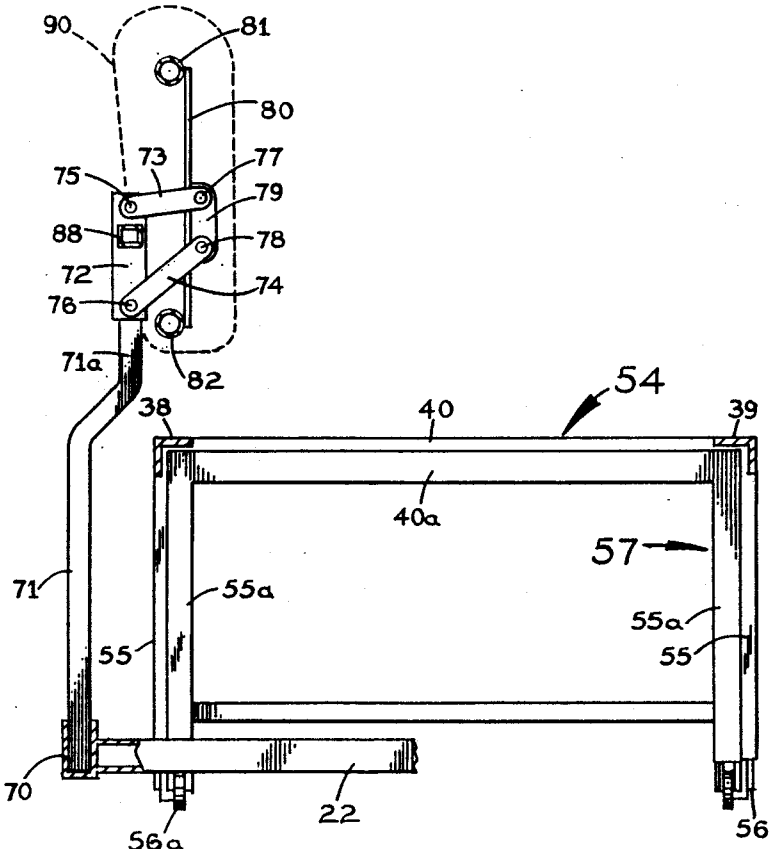
FIG. 7 is a vertical cross section taken along the line 7—7 in FIG. 1 and showing a back rest in the seating device substantially vertical.
Figure 8:
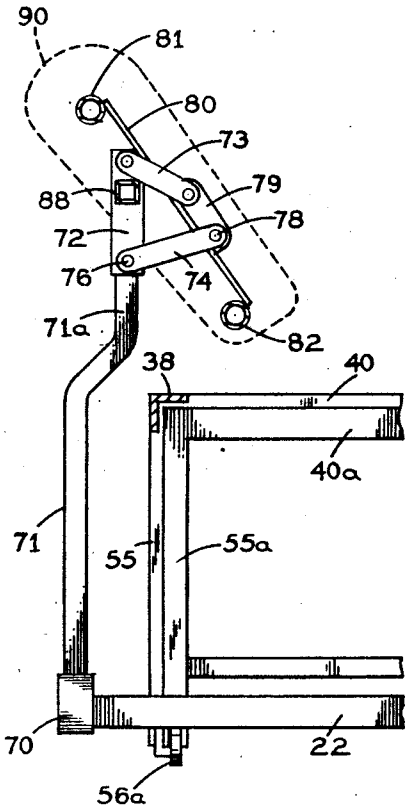
FIG. 8 is a view like FIG. 7 and showing the back rest at a different angle.
Figure 9:
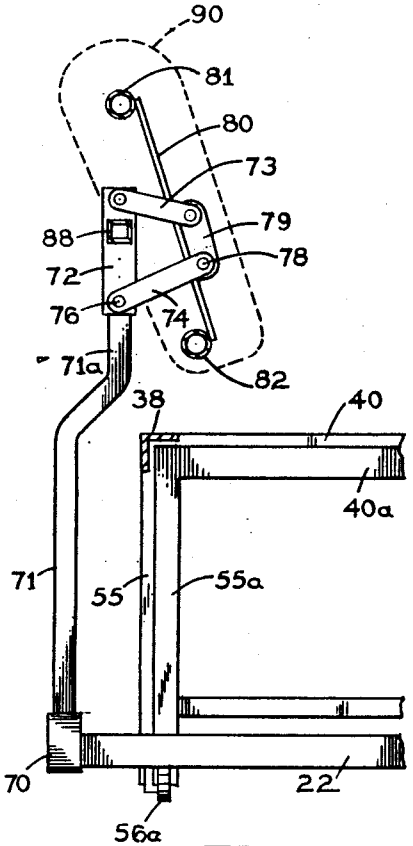
FIG. 9 is a view like FIGS. 7 and 8 and showing the back rest at an intermediate position between those of FIGS. 7 and 8.

In accordance with another important aspect of this invention, an adjustable frame for a cushioned beck rest is provided for each half of the fixed first frame 15. FIGS. 7–9 show the back-rest frame on the right side in FIG. 3.

As shown in FIG. 7, the curved outer rail 22 of the fixed first frame 15 at its back end carries an open-topped socket 70 of rectangular cross-section. This socket snugly but slidably receives a post 71 of rectangular cross-section which is part of the back rest frame on this side of the seating device. Post 71 has a forwardly-offset upper end segment 71*a* which carries a flat plate 72. Upper and lower linkages 73 and 74 are pivoted to plate 72 at 75 and 76, respectively. These linkages extend forward from the post and their front ends are pivoted at 77 and 78 to a piece 79 on the front of a vertical strut 80 of the back-rest frame. Strut 80 is shown in front elevation in FIG. 1 end in rear elevation in FIG. 2. The lower linkage 74 is the longer of the two pivoted linkages.

Figure 2:
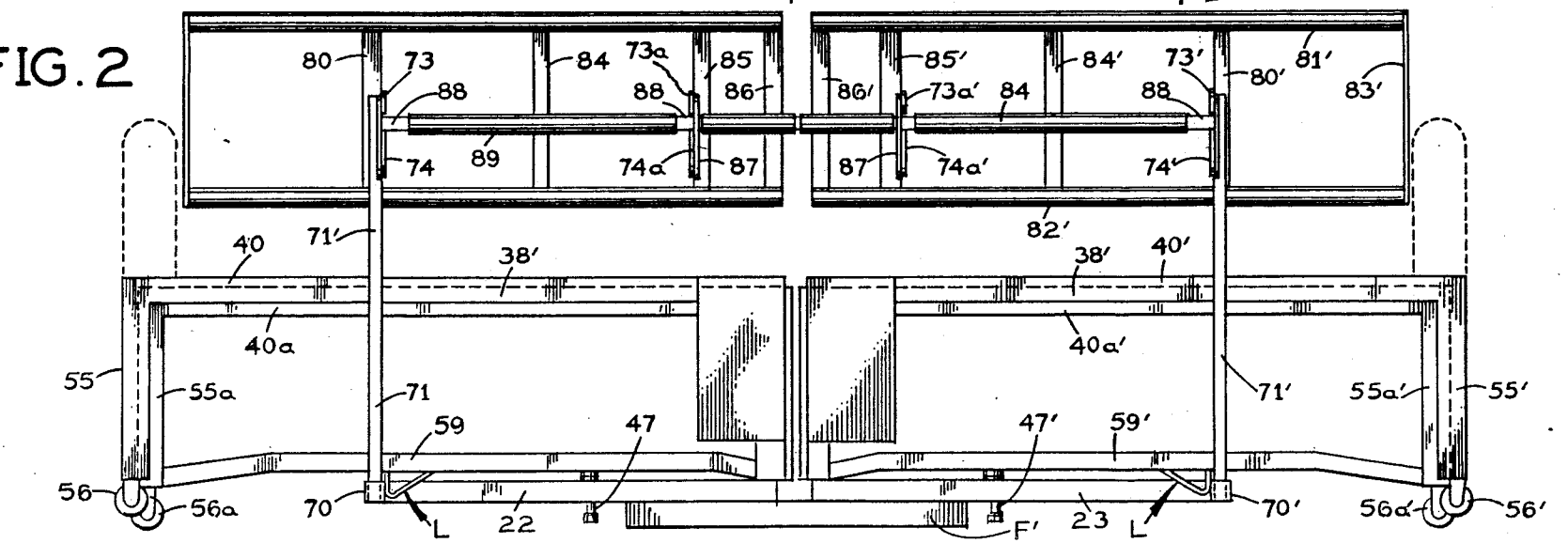
FIG. 2 is a rear elevation.

As shown in FIG. 1, the back-rest frame on this side of the seating device has a horizontal upper longitudinal rail 81 and a horizontal lower longitudinal rail 82. Strut 80 extends between and is rigidly joined to rails 81 and 82, as are an outer end piece 83, additional struts 84 and 85, and an inner end strut 86.

Strut 85 is located near the laterally inward end of the back-rest frame on this side of the seating device and it is pivotally connected to the front ends of upper and lower linkages 73*a* and 74*a*, which are mirror images of linkages 73 and 74 at strut 80. Linkages 73*a* and 74*a* are pivotally connected at their back ends to e plate 87 (FIG. 2) on the front of strut 85. A horizontally elongated bar 88 extends from strut 80 to (and beyond) the inner end strut 86 and is rigidly joined to these struts and to struts 84 and 85 between. A plastic sleeve 89 surrounds bar 88 for most of its length.

A back rest cushion 90 (FIG. 7) encloses the upper and lower longitudinal rails 81 and 82, struts 80,84,85 and 86, and end pate 83 of the back-rest frame. This cushion is recessed to permit pivotal movement of linkages 73, 74 73*a* and 74*a*.

FIG. 7 shows the substantially vertical position of this cushion. The upper linkage 73 is almost horizontal, with a slight forward end upward inclination, and the lower linkage 74 extends forward and upward at a greater angle (about 45 degrees to the horizontal).

As shown in FIG. 8, the back-rest cushion 90 can be tilted to an angle of about 30 degrees to the vertical. In this position, the upper linkage 73 is inclined forward and downward at about a 20 degree angle to the horizontal and the lower linkage 74 is inclined forward and upward at about a 10 degree angle to the horizontal.

As shown in FIG. 9, the beck-rest cushion 90 can be positioned part way between the extreme positions shown in FIGS. 7 and 8. In this intermediate position, the cushion extends forward and downward at a smaller angle to the vertical than in FIG. 8, the upper linkage 73 extends downward and forward at a smaller angle to the horizontal than in FIG. 8, and the lower linkage 74 extends upward and forward at a great angle to the horizontal than in FIG. 8.

The linkages 73*a* and 74*a* near the laterally inward end of this back-rest cushion have the same angular positions as linkages 73 and 74 in each position of the back rest.

When a person leans back against the back rest cushion, its pivotally adjustable frame automatically adjusts to the person's back for maximum comfort.

On the opposite side of the present seating device, a similar back rest frame is provided, which is a mirror image of the one just described. Corresponding elements of this frame are given the same reference numerals, with a "prime" suffix added, in FIGS. 1 and 2 so that the detailed description of these elements need not be repeated.

ARM RESTS

Another important feature of this invention is the detachable arm rests which will be in place when the seating device is being used as a sofa.

Figure 12:
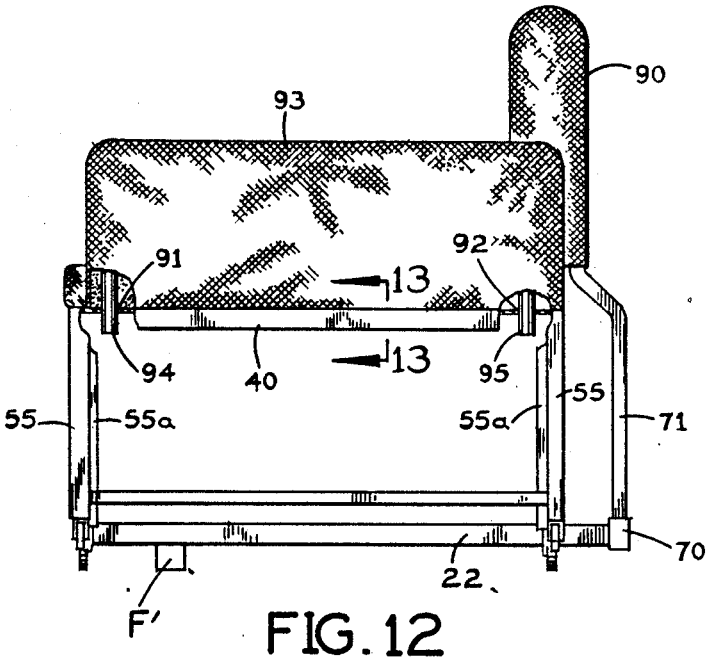
FIG. 12 is an end elevation of the seating device with the arm and back cushions on and with certain parts broken way.

As shown in FIG. 3, the top outer end rail 40 of the upper frame member 54 of second frame 36 has circular openings 91 and 92 near its front and back ends, respectively. These top rail openings are also shown in FIG. 12. An arm rest 93 carries downwardly projecting pins 94 and 95 which are snugly but slidably receivable in openings 91 and 92, respectively.

Figure 13:
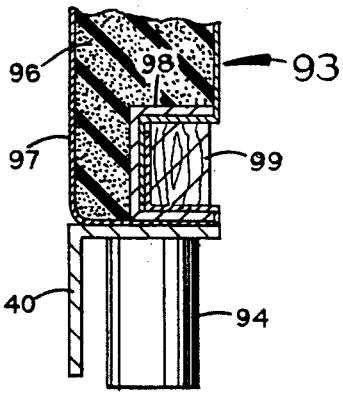
FIG. 13 is an enlarged fragmentary vertical section taken along the line 13—13 in FIG. 12.

As shown in FIG. 13, the arm rest has a core 96 of foam rubber or the like which is enclosed within a fabric cover 97. Along the bottom the arm rest has a rigid channel 98 defining a rectangular recess that is open on the laterally inward side of the arm rest. The ends of the fabric cover overlap in this recess and ere held in place by a block 99 of wood or the like.

An identical arm rest is provided on the other side.

Normally, the arm rests will be in place when the seating device is being used as a sofa and will be removed when the seating device is used as a bed.

For shipping purposes, the arm rests and the back rests will be detached from the frame assembly of the seating device. Also, the arm rests and the back rests may be removed when the seating device is being used as a bed.

From the foregoing detailed description and the accompanying drawings it will be evident that the modifications and improvements provided by the present invention enhance the practical utility and the ease of using the adjustable seating device which except for these changes is substantially like the one disclosed in my U.S. Pat. No. 3,825,929. The locking arrangement of the present invention works automatically and requires very little effort by the person adjusting the frames. The removable back rests adjust automatically to the position of a person or persons sitting on the couch. The arm rests are readily attachable or removable, when desired.

I claim:

1. In a seating device having a first frame supported horizontally above floor level end having an elongated outer rail, and a second frame angularly adjustable horizontally on said first frame between a retracted position and an extended position at substantially a right angle to said retracted position, the improvement which comprises:

a downwardly projecting lock member on said second frame for releasable locking engagement with said outer rail of said first frame, said lock member riding over said outer rail in the adjustment of said second rail between said retracted and extended positions, said lock member engaging the laterally inward edge of said outer rail when said second frame is in said retracted position:

and compressible and resilient members acting between said first and second frames and permitting said second frame to move down under the weight of a person, thereby moving said lock member down farther next to said outer rail of said first frame when said second frame is in said retracted position.

2. A seating device according to claim 1 and further comprising:

elongated trackways in said first frame;

and guide pins extending down from said second frame and slideably received in said trackways to guide said adjustment of the second frame between said retracted and extended positions;

and wherein:

said compressible and resilient members are rings of rubber-like material encircling said guide pins and sandwiched vertically between said first and second frames.

3. A seating device according to claim 1 and further comprising:

a socket on the back end of said outer rail of said first frame, said socket having a recess therein which is open at the top;

and a back rest having a post whose lower end is slidably received in said recess in the socket.

4. A seating device according to claim 3 wherein:

said back rest has a pillow-supporting frame at the upper end of said post a substantial distance above said second frame that is angularly adjustable against the back of a person leaning against said back rest.

5. In a seating device having a first frame supported horizontally above floor level and having an elongated outer rail, and seat means angularly adjustable horizontally between a retracted position and an extended position at substantially a right angle to said retracted position, said seat means including a second frame riding on said first frame, the improvement which comprises:

a lock member on said second frame for releasable locking engagement with said outer rail of said first frame, said lock member having a downwardly and laterally outwardly inclined inner segment, a rounded bottom segment joined to said inclined inner segment at its lower end, and a substantially vertical outer segment extending up from said rounded bottom segment;

said outer segment of said lock member extending down along the laterally inward edge of said outer rail of said first frame in said retracted position of said seat means;

said rounded bottom segment of said lock member riding up over said outer rail of said first frame in the initial movement of said seat means from said retracted position toward said extended position;

and said inclined inner segment of said lock member riding up over said outer rail of said first frame in the final movement of said seat means from said extended position toward said retracted position.

6. A seating device according to claim 5 and further comprising:

compressible and resilient members engaged vertically between said first and second frames end permitting said second frame to move down under the weight of a person on said seat means, thereby moving said lock member farther down next to said laterally inward edge of said outer rail in said retracted position of said seat members.

7. A seating device according to claim 6 and further comprising:

elongated trackways in said first frame;

and guide pins extending down from said second frame and slidably received in said trackways to guide said adjustment of said seat means between said retracted and extended positions;

and wherein:

said compressible and resilient members are rings of rubber-like material encircling said guide pins and sandwiched vertically between said first and second frames.

8. A seating device according to claim 5 and further comprising:

an open-topped socket on the back end of said first frame;

and a back rest having a post whose lower end is slidably received in said socket and is slidably removable therefrom.

9. A seating device according to claim 8 wherein:

said back rest has an angularly adjustable pillow-supporting frame at the upper end of said post a substantial distance above said second frame.

10. In a seating device having a first frame supported horizontally above floor level, said first frame having a longitudinal centerline and a pair of elongated outer rails on opposite sides of said centerline, and a pair of second frames on top of said first frame on opposite sides of said centerline, each of said second frames being angularly adjustable horizontally on said first frame between a retracted position and an extended position at substantially a right angle to said retracted position, the improvement which comprises:

a respective downwardly projecting lock member on each of said second frames for releasable locking engagement with the corresponding outer rail on the same side of said first frame, each said lock member riding over said corresponding outer rail in the adjustment of said second rail between said retracted end extended positions, each said lock member engaging the laterally inward edge of said corresponding outer rail when the corresponding second frame is in said retracted position;

and compressible and resilient: members acting between each of said second frames and said first frame and permitting each said second frame to move down under the weight of a person, thereby moving said lock member on said second frame down farther next to the corresponding outer rail when said second frame is in said retracted position.

11. A seating device according to claim 10 and further comprising:

elongated trackways in said first frame on opposite sides of said centerline;

and guide pins extending down from said second frames and slidably received in said trackways to guide said adjustment of each second frame between said retracted and extended positions;

and wherein:

said compressible and resilient members are rings of rubber-like material encircling said guide pins and sandwiched vertically between said first frame and the respective second frame.

12. A seating device according to claim 11 and further comprising:

a pair of open-topped sockets respectively on the back ends of said outer rails of said first frame;

and a pair of back rests on opposite sides of said centerline, each of said back rests having a post whose lower end is slidably received removably in said socket on the same side of said centerline, end each of said back rests having a pillow-supporting frame at the upper end of the corresponding post a substantial distance above said second frames which is angularly adjustable against the back of a person leaning against said back rest.

13. A seating device according to claim 11 wherein:

each of said second frames has a top outer rail which extends along the laterally outward extremity of said second frame in its retracted position, each of said top outer rails having vertical openings therein;

and further comprising:

a pair of arm rests for overlying engagement with said top outer rails of the respective second frames, each of said arm rests having downwardly projecting pins which are snugly but slidably receivable in said openings in said top outer rail of the corresponding second frame to releasably mount said arm rest on said outer rail.

* * * * *